US006692828B2

(12) United States Patent
Song et al.

(10) Patent No.: US 6,692,828 B2
(45) Date of Patent: Feb. 17, 2004

(54) HIGH CHLORINE AND HEAT RESISTANT SPANDEX FIBER AND MANUFACTURING METHOD THEREOF

(75) Inventors: Byung Su Song, Ansan-shi (KR); Tae Woo Lee, Yongin-shi (KR); Ji Won Kim, Seoul (KR); Seung Won Seo, Kunpo-shi (KR); Dae Hwi Lee, Chungjoo-shi (KR)

(73) Assignees: Hyosung Corporation, Seoul (KR); Doobon Inc., Chungcheongbuk-do (KR)

( * ) Notice: Subject to any disclaimer, the term of this patent is extended or adjusted under 35 U.S.C. 154(b) by 0 days.

(21) Appl. No.: 10/253,026

(22) Filed: Sep. 24, 2002

(65) Prior Publication Data

US 2003/0203199 A1 Oct. 30, 2003

(30) Foreign Application Priority Data

Apr. 29, 2002 (KR) ..... 2002-23400

(51) Int. Cl.[7] ..... D02G 3/00; D01F 9/00

(52) U.S. Cl. ..... 428/372; 428/364; 428/394; 428/395; 264/183; 264/184

(58) Field of Search ..... 428/372, 364, 428/394, 395; 264/183, 184

(56) References Cited

U.S. PATENT DOCUMENTS

| | | | | |
|---|---|---|---|---|
| 4,340,527 A | | 7/1982 | Martin | |
| 5,447,969 A | | 9/1995 | Kojima et al. | |
| 5,626,960 A | | 5/1997 | Carney | |
| 5,969,008 A | * | 10/1999 | Hutte et al. | 523/206 |
| 2003/0073772 A1 | * | 4/2003 | Houser et al. | 524/442 |

FOREIGN PATENT DOCUMENTS

| | | | | |
|---|---|---|---|---|
| EP | 843029 A1 | * | 5/1998 | D01F/1/10 |
| JP | 59-133248 | | 7/1984 | |
| JP | 6-81215 | | 3/1994 | |
| JP | 10168657 A | * | 6/1998 | D01F/6/70 |
| KR | 1992-0003250 | | 4/1992 | |

* cited by examiner

*Primary Examiner*—Cynthia H. Kelly
*Assistant Examiner*—J. M. Gray
(74) *Attorney, Agent, or Firm*—Bell, Boyd & Lloyd LLC

(57) ABSTRACT

Disclosed is a spandex fiber prepared to be excellent in resistance to both chlorine and heat without affecting the properties of the polyurethane polymer, and manufacturing method thereof. The spandex fiber contains hydrotalcite coated with 0.1 to 10 wt. % of a melamine-based compound. The melamine-based compound includes melamine compounds, phosphor-associated melamine compounds, melamine cyanurate compounds, melamine compounds substituted with an organic compound having a carboxyl group, phosphor-associated melamine compounds substituted with an organic compound having a carboxyl group, or melamine cyanurate compounds substituted with an organic compound having a carboxyl group, which are used alone or in combination. The spandex fiber has a high resistance to both chlorine and heat and is therefore useful for underwear, socks, and particularly, sports apparels such as swimsuit.

9 Claims, No Drawings

HIGH CHLORINE AND HEAT RESISTANT SPANDEX FIBER AND MANUFACTURING METHOD THEREOF

BACKGROUND OF THE INVENTION

1. Field of the Invention

The present invention relates to spandex fiber excellent in resistance to both chlorine and heat and manufacturing method thereof, and more particularly, to spandex fiber which has high resistance to both chlorine and heat without affecting intrinsic properties of the polyurethane polymer, and manufacturing method thereof.

2. Background of the Related Art

Spandex fiber is generally excellent in physical properties such as tensile strength, elastic recoverability, etc. and still has high rubber elasticity and therefore widely used for underwear, socks, sports apparel, etc.

Nevertheless, when washed with chlorine bleaching, spandex fiber has a considerable deterioration of physical properties in the portion of polyurethane, which is the principal component of spandex. For swimsuit made of spandex and polyamide, a contact with chlorinated water (containing 0.5 to 3.5 ppm of active chlorine) in a swimming pool also deteriorates the properties of spandex.

In an attempt to improve the resistance to chlorine-induced deterioration, the use of additives as a chlorine resisting agent has been proposed, the chlorine resisting agent being zinc oxide (U.S. Pat. No. 4,340,527), a mixture of huntite and hydromagnesite (U.S. Pat. No. 5,626,960), calcium carbonate or barium carbonate (Korean Patent Publication No. 92-3250), MgO/ZnO solid (Japanese Patent Laid-open No. 1994-81215), magnesium oxide, magnesium hydroxide or hydrotalcite (Japanese Patent Laid-open No. 1984-133248), and hydrotalcite coated with stearic acid (U.S. Pat. No. 5,447,969).

Especially, U.S. Pat. No. 5,447,969 discloses the use of a hydrotalcite coated with stearic acid to prevent water absorption of the hydrotalcite and thereby to improve the problem in regard to a rise of pack pressure and yarn breakage in the spinning process. But there is almost no difference in chlorine resistance as compared with the case of using a non-coated hydrotalcite.

SUMMARY OF THE INVENTION

Accordingly, the present invention is directed to a spandex fiber excellent in resistance to both chlorine and heat and manufacturing method thereof that substantially obviates problems due to limitations and disadvantages of the foregoing related art.

An object of the present invention is to provide a spandex fiber with improved resistance to both chlorine and heat.

The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a spandex fiber excellent in resistance to chlorine and heat that contains a hydrotalcite coated with melamine-based compounds, the hydrotalcite being represented by the following formula (1):

$$M^{2+}{}_{x}Al_{m}(OH)_{y}(A^{k-})_{z}\cdot nH_{2}O \quad (1)$$

wherein $M^{2+}$ is $Mg^{2+}$ or $Zn^{2+}$; $A^{k-}$ is an k-valent anion; x and y are a positive number which is 2 or greater than 2 ; and Z, m and n are a positive number.

Preferably, the hydrotalcite is selected from the compounds of the following formulas (2) to (6):

$$Mg_{4.5}Al_{2}(OH)_{13}CO_{3}\cdot 3.5H_{2}O \quad (2)$$

$$Mg_{6}Al_{2}(OH)_{16}CO_{3}\cdot 5H_{2}O \quad (3)$$

$$Mg_{8}Al_{2}(OH)_{20}CO_{3}\cdot 6H_{2}O \quad (4)$$

$$Mg_{6}Al_{2}(OH)_{12}(CO_{3})_{3}\cdot 7H_{2}O \quad (5)$$

$$Mg_{4}Al_{2}(OH)_{12}CO_{3}\cdot 3H_{2}O \quad (6)$$

Preferably, the melamine-based compounds include melamine compounds, phosphor-associated melamine compounds, melamine cyanurate compounds, melamine compounds substituted with an organic compound having a carboxyl group, phosphor-associated melamine compounds substituted with an organic compound having a carboxyl group, or melamine cyanurate compounds substituted with an organic compound having a carboxyl group, which may be used alone or in combination.

Preferably, the content of the hydrotalcite coated with the melamine-based compounds in fiber is 0.1 to 10 wt. %.

Preferably, the average particle diameter of the hydrotalcite coated with the melamine-based compound is 0. 1 to 10 $\mu$m.

In another aspect of the present invention, there is provided a method for manufacturing spandex fiber excellent in resistance to chlorine and heat, the method including: coating the hydrotalcite with melamine-based compounds; adding the hydrotalcite coated with the melamine compounds to a polyurethane solution; and spinning the polyurethane solution into fiber.

Preferably, the coated amount of the melamine-based compound with respect to the hydrotalcite is 0.1 to 10 wt. %.

DETAILED DESCRIPTION OF THE PREFERRED EMBODIMENT

Hereinafter, the present invention will be described in further detail.

As a result of repeated experiments and researches, the inventors have found that spandex fiber excellent in resistance to both chlorine and heat relative to the prior art can be achieved by using a hydrotalcite coated with melamine-based compounds as a chlorine resisting agent.

When added to a polymer without being coated, however, hydrotalcite is likely to absorb water with a consequence of gellation and agglomeration. Thus a rise of pack pressure and yam breakage are caused in the process of spinning, as a result of which stabilized spinning of the yarn over a long period of time is difficult to achieve.

Accordingly, the present invention provides a spandex fiber excellent in resistance to chlorine and heat relative to the prior art by coating the hydrotalcite with heat resistant melamine-based compounds.

The added amount of the melamine-based compounds with respect to the hydrotalcite is desirably in the range of 0.1 to 10 wt. %. When the amount is below the range, the chlorine resisting agent is liable to absorb water and agglomerate while added to the polymer, thereby causing yam breakage, waved fiber formation and non-uniform yam properties. When the amount exceeds 10 wt. %, the coating effect is almost the same as in the case of the amount less than 10 wt. %.

A coating method as used herein involves adding the melamine-based compound to a solvent such as water, alcohol, ether, dioxane, etc. in an amount of 0.1 to 10 wt. % with respect to hydrotalcite, adding the hydrotalcite to the solution having the melamine-based compound, coating the hydrotalcite with the melamine-based compound at a raised temperature of 50 to 170° C. (if necessary, using a high-pressure reactor) with stirring for about 30 minutes to 2 hours, and subjecting the resultant mixture to filtering and drying. An alternative coating method is a physical mixing method that involves mixing the melamine-based compound dissolved in a solvent with hydrotalcite in a high-speed mixer and drying the mixture.

The melamine-based compound is not only used to coat the hydrotalcite but also to make the spandex fiber excellent in resistance to both chlorine and heat relative to the case of using the conventional coating material, such as stearic acid.

The melamine-based compounds as used herein include melamine compounds; phosphor-associated melamine compounds; melamine cyanurate compounds; melamine compounds substituted with an organic compound having a carboxyl group; phosphor-associated melamine compounds substituted with an organic compound having a carboxyl group; or melamine cyanurate compounds substituted with an organic compound having a carboxyl group, which may be used alone or in combination.

More specifically, the melamine compounds may include methylene dimelamine, ethylene dimelamine, trimethylene dimelamine, tetramethylene dimelamine, hexamethylene dimelamine, decamethylene dimelamine, dodecamethylene dimelamine, 1,3-cyclohexylene dimelamine, p-phenylene dimelamine, p-xylene dimelamine, diethylene trimelamine, triethylene tetramelamine, tetraethylene pentamelamine, or hexaethylene heptamelamine.

The phosphor-associated melamine compounds may include any of the above-mentioned melamine compounds associated with phosphoric acid or phosphate. Specific examples of the phosphor-associated melamine compounds may include dimelamine pyrophosphate, melamine primary phosphate, melamine secondary phosphate, or melamine polyphosphate.

The melamine cyanurate compounds may include substituted or unsubstituted melamine cyanurates, the substituted melamine cyanurates having at least one substituent, such as methyl, phenyl, carboxymethyl, 2-carboxyethyl, cyanomethyl or 2-cyanoethyl.

Preferably, the melamine-based compounds contain an organic compound having a carboxyl group. Specific examples of the organic compound having a carboxyl group may include aliphatic monocarboxylic acids (e.g., caprylic acid, undecanoic acid, lauric acid, tridecanoic acid, myristic acid, pentadecanoic acid, hexadecanoic acid, heptadecanoic acid, stearic acid, nonadecanoic acid, eicosanoic acid or behenic acid); aliphatic dicarboxylic acids (e.g., malonic acid, succinic acid, glutaric acid, adipic acid, pimelic acid, suberic acid, azelaic acid, sebasic acid, 1,9-nonanedicarboylic acid, 1,10-decanedicarboxylic acid, 1,11-undecanedicarboxylic acid, 1,12-dodecanedicarboxylic acid, 1,13-tridecanedicarboxylic acid or 1,14-tetradecanedicarboxylic acid); aromatic monocarboxylic acids (e.g., benzoic acid, phenylacetic acid, alpha-naphthoic acid, beta-naphthoic acid, cynnamic acid, p-amino hippuric acid or 4-(2-thiazo(1)ylsulfamyl)-phthalaninoic acid); aromatic dicarboxylic acids (e.g., terephthalic acid, isophthalic acid or phthalic acid); aromatic tricarboxylic acids (e.g., trimellitic acid, 1,3,5-benzenetricarboxylic acid or tris(2-carboxyethyl) isocyanurate); aromatic tetracarboxylic acids (e.g., pyromellitic acid or biphenyltetracarboxylic acid); aliphatic cyclic monocarboxylic acids (e.g., cyclohexane carboxylic acid); or aliphatic cyclic dicarboxylic acids (e.g., 1,2-cyclohexane dicarboxylic acid).

The hydrotalcite as used herein is represented by the following formula (1):

$$M^{2+}{}_xAl_m(OH)_y(A^{k-})_z{\cdot}nH_2O \quad (1)$$

wherein $M^{2+}$ is $Mg^{2+}$ or $Zn^{2+}$; $A^{k-}$ is an k-valent anion; x and y are a positive number which is 2 or greater than 2; and Z, m and n are a positive number.

In the above formula, $A^{k-}$ is any ion selected from the group consisting of $OH^-$, $F^-$, $Cl^-$, $Br^-$, $NO_3^-$, $SO_4^{2-}$, $CH_3COO^-$, $CO_3^{2-}$, $HPO_4^{2-}$, $Fe(CN)_6^{3-}$, oxalate ion and salicylate ion. The preferred hydrotalcites are represented by one of the following formulas (2) to (6):

$$Mg_{4.5}Al_2(OH)_{13}CO_3{\cdot}3.5H_2O \quad (2)$$

$$Mg_6Al_2(OH)_{16}CO_3{\cdot}5H_2O \quad (3)$$

$$Mg_8Al_2(OH)_{20}CO_3{\cdot}6H_2O \quad (4)$$

$$Mg_6Al_2(OH)_{12}(CO_3)_3{\cdot}7H_2O \quad (5)$$

$$Mg_4Al_2(OH)_{12}CO_3{\cdot}3H_2O \quad (6)$$

The content of the chlorine resisting agent in the spandex fiber is in the range of 0.1 to 10 wt. %. When the content of the chlorine resisting agent is below the range, the spandex fiber has little resistance to chlorine; otherwise, when the content of the chlorine resisting agent exceeds 10 wt. %, the spandex fiber has a deterioration of strength, elasticity and modulus.

The average particle diameter of the chlorine resisting agent in the present invention is preferably less than 10 $\mu$m, more preferably less than 5 $\mu$m in the aspect of use in the process. The average particle diameter of the chlorine resisting agent exceeding 10 $\mu$m result in a rise of a pack pressure and yam breakage.

The polyurethane polymer used in the manufacture of spandex fiber of the present invention is prepared, as known to those skilled in the art, by reacting organodiisocyanate and polymer diol to prepare a polyurethane precursor, dissolving the polyurethane precursor in an organic solvent and reacting it with a diamine and a monoamine.

The organodiisocyanate as used herein may include diphenylmethane-4,4'-diisocyanate, hexamethylenediisocyanate, toluenediisocyanate, butylenediisocyanate, hydrogenated P,P-methylenediisocyanate, etc. The polymer diol as used herein may include polytetramethylene etherglycol, polypropylene glycol, polycarbonate diol, etc. The diamine as used herein is used as a chain extender and may include ethylenediamine, propylenediamine, hydrazine, etc. The monoamine as used herein is used as a chain terminator and may include diethylamine, monoethanolamine, dimethylamine, etc.

Stabilizers can be added to prevent discoloration and property deterioration of the spandex caused by UV, smog and heat treatment into the polyurethane polymer. Specific examples of the stabilizer may include hindered phenols, benzofuran-ones, semicarbazides, benzotriazols, hindered amines, or polymeric tertiary amine stabilizer, such as tertiary nitrogen containing polyurethane, poly dialkyl aminoalkyl methacrylate, etc.

The spandex fiber of the present invention may further include an additive such as titanium dioxide, magnesium stearate, etc. The added amount of the titanium dioxide is, based on the total weight of the spandex fiber, in the range of 0.1 to 5 wt. % according to the whiteness of the spandex fiber. The magnesium stearate is used to enhance the unwinding capability of the spandex fiber and added in an amount of 0.1 to 2 wt. % based on the total weight of the spandex fiber.

It is to be understood that both the foregoing general description and the following detailed description of the present invention are exemplary and explanatory and are intended to provide further explanation of the invention as claimed.

EXAMPLES 1 to 8

518 g of diphenylmethane-4,4'-diisocyanate and 2,328 g of polytetramethylene ether glycol (Mw 1,800) were reacted with stirring at 80° C. in nitrogen atmosphere for 90 minutes to prepare a polyurethane prepolymer having both isocyanate terminals. After cooling the prepolymer to the room temperature, 4,269 g of dimethylacetamide was added to obtain a polyurethane prepolymer solution. Subsequently, 34.4 g of ethylenediamine, 10.6 g of propylenediamine and 9.1 g of diethylamine were dissolved in 1,117 g of dimethylacetamide. The resultant solution was added to the prepolymer solution at less than 10° C. to prepare a polyurethane solution.

Based on the total weight of the solid portion of the polymer, 1.5 wt. % of ethylenebis(oxyethylene)bis-(3-(5-t-butyl-4-hydroxy-m-toyl)-propionate), 0.5 wt. % of 5,7-di-t-butyl-3-(3,4-dimethylphenyl)-3H-benzofuran-2-one, 1 wt. % of 1,1,1',1'-tetramethyl-4,4'-(methylene-di-p-phenylene) disemicarbazide, 1 wt. % of poly(N,N-diethyl-2-aminoethyl methacrylate), 0.1 wt. % of titanium dioxide and 0.5 wt. % of magnesium stearate were mixed with the hydrotalcite (examples 1–8) as specified in Table 1 to prepare a polyurethane spinning solution.

After defoaming the polyurethane spinning solution, the solution was subjected to a dry spinning process at a spinning temperature of 250° C. to prepare a 4-filament 40-denier spandex fiber. The properties of the spandex fiber were measured. The results are presented in Table 1.

COMPARATIVE EXAMPLES 1, 2 and 3

The procedures were performed in the same manner as described in the above examples, excepting that the type and content of the coating agent were chosen as specified in Table 1. The results are presented in Table 1.

The chlorine resistance and the heat resistance in the examples and the comparative examples were measured as follows.

Chlorine Resistance Test

Test for strength preservation rate in chlorinated water: The spandex yam subjected to 50% stretching was treated with a water (pH 4.2, 97 to 98° C.) for 2 hours and cooled down at the room temperature. After being dipped in 45L of chlorinated water (pH 7.5) containing 3.5 ppm of active chlorine for 24 hours, the spandex yarn was analyzed in regard to strength preservation rate.

* Strength preservation rate (%)=$(S/S_0)$ X 100 ($S_0$: strength before treatment, S: strength after treatment)

* An Instron 4301 (Instron Co., USA) was used for strength measurement, where the sample piece was 5 cm long and the cross head speed was 300 mm/min with a cell of 1 Kg.

Heat Resistance Test

Tubular knitted fabrics made of spandex alone with a tubular knitting machine (KT-400, 4 inches in diameter, 400 needles, Nagata Seiki Company, Japan) were cut to 5 cm for heat resistance test. The tubular knitted spandex were degummed by a known spandex degumming method using a mixture of degumming agents, 2 g/l of UNITOL CT-81 (Shinyoung Chemical, Korea) and 3 g/l of UNITOL-SMS (Shinyoung Chemical, Korea). The sample pieces were used for the following heat resistance test.

The sample pieces were treated at 195° C. for 5 minutes at a dry oven that lets air in and out.

Before and after the treatment, the yellowing value "b" of the pieces was measured by a color-view (Gardener, USA) and the difference between the yellow values before and after the treatment was calculated as Δb.

TABLE 1

| Div. | Example 1 | Example 2 | Example 3 | Example 4 | Example 5 | Example 6 |
|---|---|---|---|---|---|---|
| Coating agent | A | B | C | D | E | F |
| Coating amount | 4 wt. % | 4 wt. % | 4 wt. % | 4 wt. % | 4 wt. % | 4 wt. % |
| Hydrotalcite | $Mg_6Al_2(OH)_{16}CO_3.4H_2O$ | $Mg_{4.5}Al_2(OH)_{13}CO_3.3.5H_2O$ | $Mg_6Al_2(OH)_{16}CO_3.4H_2O$ | $Mg_6Al_2(OH)_{16}CO_3.4H_2O$ | $Mg_6Al_2(OH)_{16}CO_3.4H_2O$ | $Mg_6Al_2(OH)_{16}CO_3.4H_2O$ |
| Hydrotalcite content in fiber | 4 wt. % | 4 wt. % | 4 wt. % | 4 wt. % | 4 wt. % | 4 wt. % |
| Strength preservation rate after 24-hour treatment | 90.5% | 91% | 90% | 90% | 91% | 89% |
| Heat resistance (Δb) | 3.1 | 3.2 | 3.0 | 3.1 | 3.1 | 2.9 |

| Div. | Example 7 | Example 8 | Comparative Example 1 | Comparative Example 2 | Comparative Example 3 |
|---|---|---|---|---|---|
| Coating agent | G | H | I | J | — |
| Coating amount (with respect to hydrotalcite) | 4 wt. % | 4 wt. % | 11 wt. % | 4 wt. % | — |
| Hydrotalcite | $Mg_6Al_2(OH)_{16}CO_3.4H_2O$ | $Mg_4Al_2(OH)_{13}CO_3.3H_2O$ | $Mg_6Al_2(OH)_{16}CO_3.4H_2O$ | $Mg_{4.5}Al_2(OH)_{13}CO_3.3.5H_2O$ | $Mg_6Al_2(OH)_{16}CO_3.4H_2O$ |
| Hydrotalcite content in yarn | 4 wt. % | 4 wt. % | 4 wt. % | 4 wt. % | 4 wt. % |

TABLE 1-continued

| | | | | | |
|---|---|---|---|---|---|
| Strength preservation rate after 24-hour treatment | 88% | 89% | 83% | 83% | Impossible to measure due to a rise of pack pressure and yarn breakage |
| Heat resistance (Δb) | 2.9 | 3.0 | 2 | 6 | — |

Note)
A: Mixture of dimelamine pyrophosphate and myristic acid-substituted melamine cyanurate (1:1)
B: Mixture of dimelamine pyrophosphate and stearic acid-substituted melamine cyanurate (1:1)
C: Stearic acid-substituted melamine cyanurate
D: Stearic acid-substituted melamine
E: Stearic acid-substituted dimelamine pyrophosphate
F: Melamine
G: Melamine cyanurate
H: Dimelamine pyrophosphate
I: Myristic acid-substituted melamine cyanurate
J: Stearic acid
*Less discolored with lower Δb value.

As shown in Table 1, the spandex fiber containing a hydrotalcite coated with an appropriate amount of a melamine-based compound according to the present invention is excellent in resistance to chlorine and heat relative to the spandex fiber of the comparative example 1 containing a hydrotalcite coated with an excess of a melamine-based compound and the spandex fiber of the comparative examples 2 and 3 containing a non-coated hydrotacite.

As described above, the present invention provides a spandex fiber excellent in resistance to chlorine and heat.

The spandex fiber prepared according to the present invention has a high resistance to both chlorine and heat and is therefore useful for underwear, socks, and particularly, sports apparel such as swimsuit.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A spandex fiber comprising a hydrotalcite coated with a melamine-based compound, said hydrotalcite being represented by the following formula (1):

$$M^{2+}{}_xAl_m(OH)_y(A^{k-})_z \cdot nH_2O \quad (1)$$

wherein $M^{2+}$ is $Mg^{2+}$ or $Zn^{2}$+; $A^{k-}$ is an k-valent anion; x and y are a positive number which is 2 or greater than 2; and Z, m and n are a positive number.

2. The spandex fiber as claimed in claim 1, wherein said hydrotalcite is selected from the group consisting of compounds represented by the following formulas (2) to (6):

$$Mg_{4.5}Al_2(OH)_{13}CO_3 \cdot 3.5H_2O \quad (2)$$

$$Mg_6Al_2(OH)_{16}CO_3 \cdot 5H_2O \quad (3)$$

$$Mg_8Al_2(OH)_{20}CO_3 \cdot 6H_2O \quad (4)$$

$$Mg_6Al_2(OH)_{12}(CO_3)_3 \cdot 7H_2O \quad (5)$$

$$Mg_4Al_2(OH)_{12}CO_3 \cdot 3H_2O \quad (6).$$

3. The spandex fiber as claimed in claim 1, wherein said melamine-based compound includes compounds selected from the group consisting of melamine compounds, phosphor-associated melamine compounds, melamine cyanurate compounds, melamine compounds substituted with an organic compound having a carboxyl group, phosphor-associated melamine compounds substituted with an organic compound having a carboxyl group, and melamine cyanurate compounds substituted with an organic compound having a carboxyl group alone or in combination.

4. The spandex fiber as claimed in claim 1, wherein the content of said hydrotalcite coated with said melamine-based compound in fiber is approximately 0.1 to about 10 wt. %.

5. The spandex fiber as claimed in claim 1, wherein the average particle diameter of said hydrotalcite coated with the melamine-based compound is approximately 0.1 to about 10 $\mu$m.

6. A method for manufacturing a spandex fiber having excellent resistance to chlorine and heat, the method comprising:

coating a hydrotalcite compound with a melamine-based compound, said hydrotalcite being represented by the following formula (1):

$$M^{2+}{}_xAl_m(OH)_y(A^{k-})_z \cdot nH_2O \quad (1)$$

wherein $M^{2+}$ is $Mg^{2+}$ or $Zn^{2+}$; $A^{k-}$ is an k-valent anion; x and y are a positive number which is 2 or greater than 2; and Z, m and n are a positive number;

adding said hydrotalcite coated with said melamine compound to a polymer solution to prepare a polyurethane spinning solution; and spinning said polyurethane spinning solution.

7. The method as claimed in claim 6, wherein the coated amount of said melamine-based compound with respect to said hydrotalcite is approximately 0.1 to about 10 wt. %.

8. The method of claim 6, wherein said hydrotalcite is selected from the group consisting of compounds represented by the following formulas (2) to (6):

$$Mg_{4.5}Al_2(OH)_{13}CO_3 \cdot 3.5H_2O \quad (2)$$

$$Mg_6Al_2(OH)_{16}CO_3 \cdot 5H_2O \quad (3)$$

$$Mg_8Al_2(OH)_{20}CO_3 \cdot 6H_2O \quad (4)$$

$$Mg_6Al_2(OH)_{12}(CO_3)_3 \cdot 7H_2O \quad (5)$$

$$Mg_4Al_2(OH)_{12}CO_3 \cdot 3H_2O \quad (6).$$

9. The method of claim 6, wherein said melamine-based compound includes a compound chosen from the group consisting of melamine compounds, phosphor-associated melamine compounds, melamine cyanurate compounds, melamine compounds substituted with an organic compound having a carboxyl group, phosphor-associated melamine compounds substituted with an organic compound having a carboxyl group, and melamine cyanurate compounds substituted with an organic compound having a carboxyl group alone or in combination.

* * * * *